US009764550B2

(12) United States Patent
Ishida et al.

(10) Patent No.: US 9,764,550 B2
(45) Date of Patent: Sep. 19, 2017

(54) LIQUID EJECTION HEAD SUBSTRATE AND LIQUID EJECTION HEAD

(71) Applicant: CANON KABUSHIKI KAISHA, Tokyo (JP)

(72) Inventors: Koichi Ishida, Tokyo (JP); Shintaro Kasai, Yokohama (JP); Yoshiyuki Nakagawa, Kawasaki (JP); Akiko Saito, Tokyo (JP); Takatsugu Moriya, Tokyo (JP); Tatsuya Yamada, Kawasaki (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/188,571

(22) Filed: Jun. 21, 2016

(65) Prior Publication Data

US 2016/0375685 A1 Dec. 29, 2016

(30) Foreign Application Priority Data

Jun. 25, 2015 (JP) ..... 2015-128154

(51) Int. Cl.
*B41J 2/14* (2006.01)

(52) U.S. Cl.
CPC ..... *B41J 2/14016* (2013.01); *B41J 2/1404* (2013.01); *B41J 2/14072* (2013.01); *B41J 2/14129* (2013.01); *B41J 2/14145* (2013.01); *B41J 2002/14306* (2013.01); *B41J 2002/14467* (2013.01); *B41J 2202/12* (2013.01)

(58) Field of Classification Search
CPC B41J 2/14112; B41J 2/14016; B41J 2/14129; B41J 2/14145; B41J 2002/14306; B41J 2/14072
See application file for complete search history.

(56) References Cited

U.S. PATENT DOCUMENTS 6,003,977 A * 12/1999 Weber ..... B41J 2/1645 347/63
2014/0184700 A1* 7/2014 Sakurai ..... B41J 2/0451 347/54

FOREIGN PATENT DOCUMENTS

JP 2008-105364 A 5/2008

* cited by examiner

*Primary Examiner* — Geoffrey Mruk
(74) *Attorney, Agent, or Firm* — Canon U.S.A. Inc., IP Division

(57) ABSTRACT

A liquid ejection head substrate includes a heating resistor array including a plurality of heating resistors and a protective film covering at least one of the heating resistors. The liquid ejection head substrate further includes a supply opening array and an electrode. The supply opening array is disposed on a side of a surface of the liquid ejection head substrate on which the protective film is provided. The supply opening array includes a plurality of supply openings through which a liquid is supplied arranged in a direction along the heating resistor array. The electrode is disposed on the side of the surface in a space between the supply openings adjacent to each other in a direction along the supply opening array. The electrode is configured such that a voltage is applied between the electrode and the protective film.

18 Claims, 9 Drawing Sheets

LIQUID EJECTION HEAD SUBSTRATE AND LIQUID EJECTION HEAD

BACKGROUND OF THE INVENTION

Field of the Invention

The present invention relates to a liquid ejection head configured to eject a liquid and a liquid ejection head substrate for the liquid ejection head.

Description of the Related Art

An exemplary liquid ejection head, which is configured to eject a liquid such as ink, includes an ejection opening defining member and a liquid ejection head substrate. The ejection opening defining member has ejection openings. The liquid ejection head substrate includes a heating resistor configured to generate thermal energy for forming a bubble in the liquid. The liquid ejection head substrate has a contact portion (hereinafter, may be referred to as a "heat application portion"), which is in contact with the liquid, at a position corresponding to the heating resistor. The heating resistor heats the liquid at the heat application portion rapidly when activated. Thus, a bubble is formed in the liquid at the heat application portion. A pressure applied by the bubble causes the liquid to be ejected through the ejection opening for printing on a medium.

During the above-described process, the heat application portion of the liquid ejection head substrate may be subjected to both physical action such as an impact caused by cavitation due to bubble formation or bubble shrinkage in the liquid and chemical action caused by a liquid such as ink. A protective film covers the heating resistor so as to protect the heating resistor from the influence of such action.

When the liquid is heated at high temperature at the heat application portion, which is the contact portion where the liquid is in contact with the protective film, an additive such as a coloring material included in the liquid is decomposed and a substance having low solubility is produced. The substance having low solubility is likely to be physically adsorbed by the protective film. The physically adsorbed substance is referred to as kogation. The kogation on the protective film causes uneven heat transfer from the heating resistor to the liquid, leading to unstable bubble formation. This may result in unstable liquid ejection.

Japanese Patent Laid-Open No. 2008-105364 describes a method of cleaning the liquid ejection head. In the method, an electrode is disposed and a voltage is applied such that the protective film becomes a positive side and the electrode becomes a negative side. This causes an electrical chemical reaction between the liquid and a component of the protective film, causing the surface of the protective film to be eluted in the liquid. Thus, the kogation is eliminated.

In the elimination of the kogation by using the electrical chemical reaction, the component of the protective film is eluted rapidly in an area of the protective film adjacent to the electrode and is eluted slowly in an area of the protective film remote from the electrode. The influence of the difference in the elution speed in the protective film, which varies depending on the distance from the electrode, is reduced by separating the protective film from the electrode by a sufficient distance. However, if the distance between the protective film and the electrode is short, the difference in the elution speed is large. In this case, the thickness of the protective film may vary if cleaning of the liquid ejection head continues. The variation in the thickness of the protective film may lead to uneven heat transfer to the liquid, and the liquid ejection head may fail to stably form a bubble in the liquid. Thus, stable liquid ejection is unlikely to be maintained.

If the electrode is disposed at a position sufficiently remote from the protective film, the size of the liquid ejection head may be increased depending on the position of the electrode.

The present invention provides a liquid ejection head substrate having a small size and enabling stable liquid ejection. The stable liquid ejection is achieved by separating a protective film from an electrode by a sufficient distance to reduce variation in the elution amount, which is the amount of a component eluted from the protective film, depending on the position in the protective film.

SUMMARY OF THE INVENTION

The present invention provides a liquid ejection head substrate including a heating resistor array, a protective film, a supply opening array, and an electrode. The heating resistor array includes a plurality of heating resistors. The protective film covers at least one of the heating resistors. The supply opening array is disposed on a side of a surface of the liquid ejection head substrate on which the protective film is provided. The supply opening array includes a plurality of supply openings through which a liquid is supplied arranged in a direction along the heating resistor array. The electrode is disposed on the side of the surface in a space between the supply openings adjacent to each other in a direction along the supply opening array. The electrode is configured such that a voltage is applied between the electrode and the protective film.

Further features of the present invention will become apparent from the following description of exemplary embodiments with reference to the attached drawings.

DESCRIPTION OF THE EMBODIMENTS

The present invention enables a liquid ejection head substrate to have a small size and enables stable liquid ejection. The stable liquid ejection is achieved by separating a protective film from an electrode by a sufficient distance to reduce a difference in the elution amount depending on the position in the protective film.

Liquid Ejection Apparatus

Figure 1:
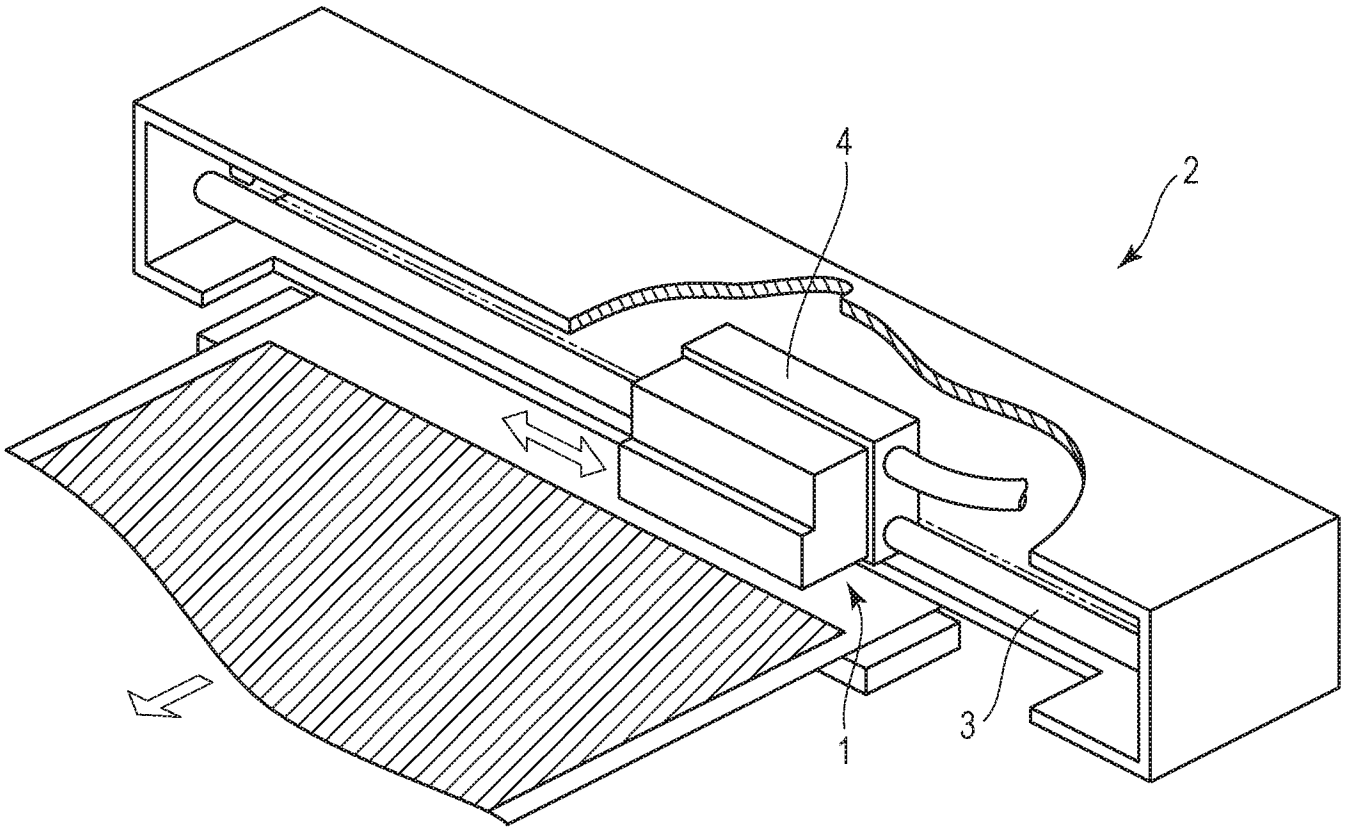
FIG. 1 is a perspective view of a liquid ejection apparatus.

FIG. 1 illustrates a liquid ejection apparatus 2 including a liquid ejection head unit 1 according to an embodiment of the present invention. The liquid ejection apparatus 2 of the present embodiment is a serial scan type recording apparatus. A guide shaft 3 guides a carriage 4 so as to move in a main scanning direction. The liquid ejection head unit 1 is mounted on the carriage 4 so as to be mounted in the liquid ejection apparatus 2 in a movable manner relative to a recording medium. The carriage 4 reciprocates in the main scanning direction by using a carriage motor (not illustrated) and a driving force transfer mechanism such as a belt (not illustrated), which transmits a driving force generated by the carriage motor. The liquid ejection apparatus 2 repeats a recording action and a conveying action while moving the liquid ejection head unit 1 in the main scanning direction for printing. In the recording action, a liquid such as ink is ejected onto the recording medium. In the conveying action, the recording medium is conveyed in a sub scanning direction by a distance corresponding to a printing width. During the printing, the liquid ejection apparatus 2 conveys the recording medium by a conveying mechanism such as a roller (not illustrated) in a conveyance direction intersecting the main scanning direction of the liquid ejection head unit 1.

Liquid Ejection Head Unit

Figure 2:
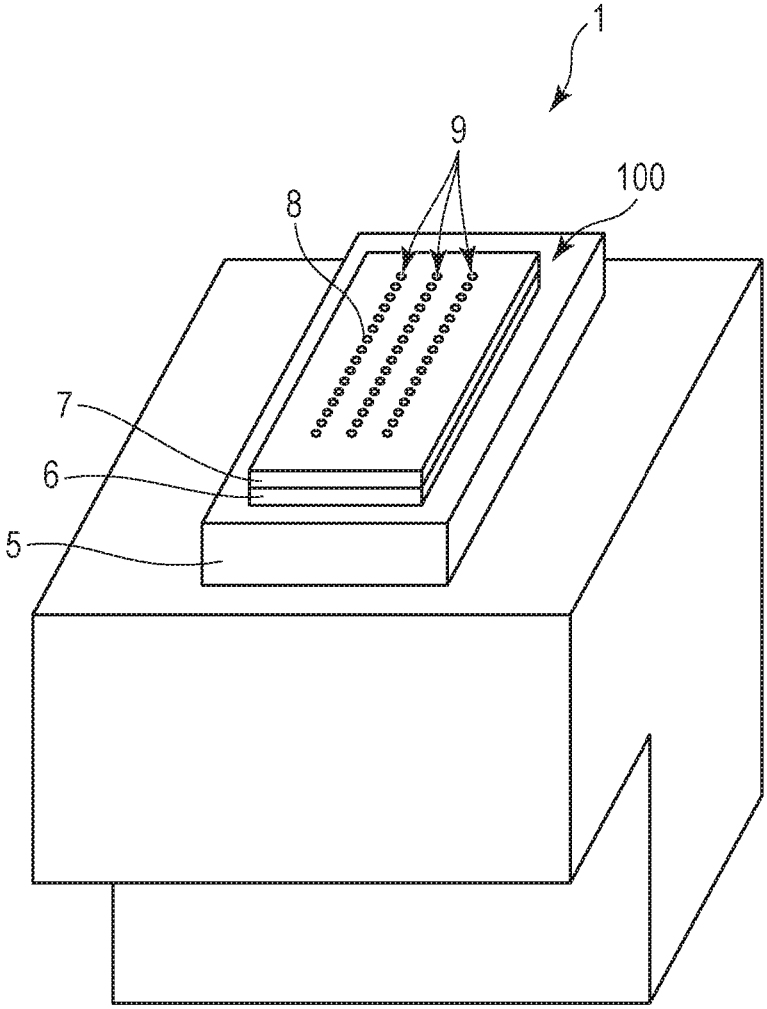
FIG. 2 is a perspective view of a liquid ejection head unit.

FIG. 2 is a perspective view of the liquid ejection head unit 1 illustrated in FIG. 1. The liquid ejection head unit 1 includes a support 5 and a liquid ejection head 100 connected to each other.

The liquid ejection head 100 includes a substrate 6, which is a liquid ejection head substrate, and an ejection opening defining member 7 connected to the substrate 6. The ejection opening defining member 7 includes a plurality of ejection opening arrays 9 each having a plurality of ejection openings 8 through which the liquid is ejected at substantially equal spacing. The liquid stored in a tank, which is not illustrated, is supplied to the liquid ejection head 100 through a channel in the support 5.

First Embodiment

Figure 3A:
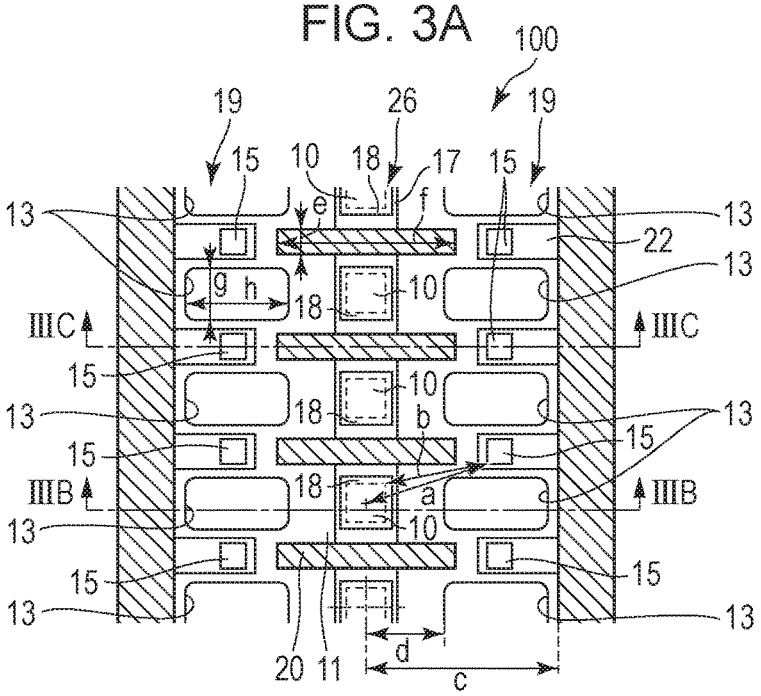
FIGS. 3A to 3D are views of the liquid ejection head according to a first embodiment each illustrating a portion including a heating resistor.
Figure 3B:
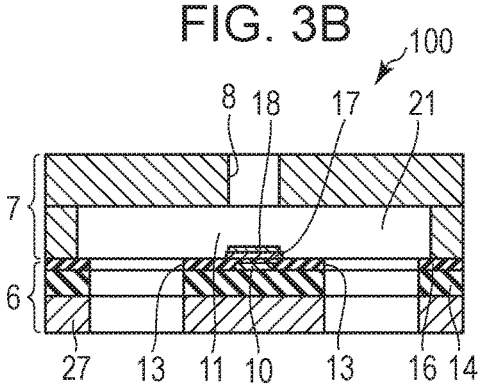
Figure 3C:
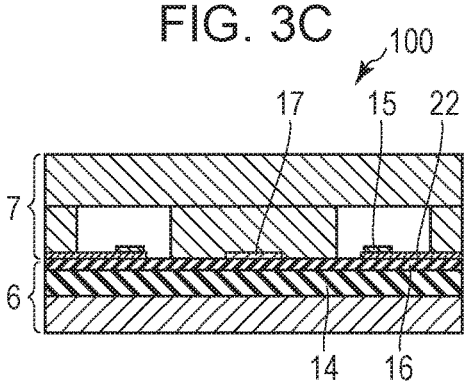
Figure 3D:
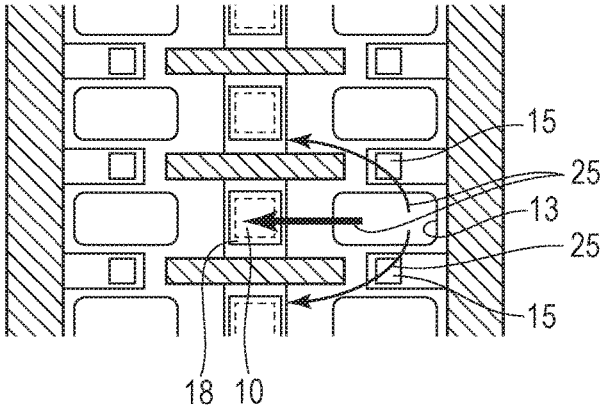

The liquid ejection head 100 according to a first embodiment is described with reference to FIGS. 3A to 3D. FIGS. 3A to 3D are views of the liquid ejection head 100, which is illustrated in FIG. 2, and illustrate a portion including a heating resistor 10. FIG. 3A is a partial plan view illustrating a section of the liquid ejection head 100. FIG. 3B is a cross-sectional view taken along line IIIB-IIIB in FIG. 3A. FIG. 3C is a cross-sectional view taken along line IIIC-IIIC in FIG. 3A. FIG. 3D illustrates a flow of the liquid during suction recovery.

The substrate 6 includes a heating resistor array 26 facing the ejection openings 8. The heating resistor array 26 includes a plurality of heating resistors 10 configured to generate thermal energy for ejecting the liquid and extends in a direction along the ejection opening arrays 9. The ejection opening arrays 9 and the heating resistor array 26 extend in a longitudinal direction of the liquid ejection head 100 or a longitudinal direction of the substrate 6.

A partition 20 is disposed between the heating resistors 10 adjacent to each other in the direction along the ejection opening arrays 9 so as to divide a pressure chamber 11 in which the heating resistors 10 are disposed. In this embodiment, the partition 20 has a width e (FIG. 3A) of 12 μm and a length f (FIG. 3A) of 70μ, but the invention is not limited to these values.

The substrate 6 has a plurality of supply openings 13 through which the liquid is supplied to the pressure chamber 11. The supply openings 13 are arranged in the direction along the ejection opening arrays 9 or in the direction along the heating resistor array 26. The supply openings 13 form supply opening arrays 19 extending in the longitudinal direction of the substrate 6. The supply opening arrays 19 are positioned with the heating resistor array 26 disposed therebetween. The supply openings 13 of this embodiment each have a substantially rectangular shape. The supply opening 13 has a width g (FIG. 3A) of 20 μm and a length h (FIG. 3A) of 40 μm on a surface of the substrate 6, but the invention is not limited to these values. A distance d (FIG. 3A) between the center of gravity of the heating resistor 10, i.e., the center of mass of the heating resistor 10, and an end of the supply opening 13 adjacent to the heating resistor 10 is 30 μm on the surface of the substrate 6. The mass of the heating resistor 10 is assumed to be distributed evenly.

The substrate 6 and the ejection defining member connected to each other define liquid chambers 21 and allow the supply openings 13 positioned with the pressure chamber 11 disposed therebetween to be in communication with each other (FIG. 3B). A distance c (FIG. 3A) between the center of gravity of the heating resistor 10 and a wall defining the liquid chamber 21 is 75 μm, but the invention is not limited to this value.

A layered structure of the substrate 6 is described. As illustrated in FIG. 3B, the substrate 6 includes a base 27 and an insulating layer 14 on the base 27. The base 27 may be formed of silicon, for example. The insulating layer 14 may be formed of $SiO_2$ or SiN, for example. The heating resistor 10 disposed on the substrate 6 may be formed of TaSiN, for example, and is connected to an electrode wiring layer, which is not illustrated. The electrode wiring layer is electrically connected to an external terminal such that power is supplied to the heating resistor 10 through the electrode wiring layer to heat the heating resistor 10. This forms a bubble in the liquid in contact with the heat application portion corresponding to the heating resistor 10, and the bubble causes liquid to be ejected.

The heating resistor 10 is covered with an insulating layer 16 formed of SiN, for example. An adhesion layer 17 formed of Ta, for example, and protective films 18 are disposed on the insulating layer 16 on a side adjacent to the ejection opening defining member 7. The protective films 18 each cover a corresponding one of the heating resistors 10. The adhesion layer 17 is electrically connected to an external terminal through an electrode wiring layer, which is not illustrated, to electrically connect the protective films 18 to the external terminal.

The protective film 18 may be formed of a platinum group material such as iridium (Ir) or ruthenium (Ru), which is eluted in an electrolytic solution having a relatively low pH value. The insulating layer 16 and the adhesion layer 17 are optional components, and the protective film 18 may cover the heating resistor 10 directly. In this embodiment, the protective film 18 covers an entire surface of the heating resistor 10. The protective film 18 on the substrate 6 has a size of 20 μm×20 μm, but the invention is not limited to this value.

As illustrated in FIG. 3A and FIG. 3C, electrodes are disposed on the substrate 6 such that an electrochemical reaction is caused between the liquid and the protective films 18. Each of the electrodes 15 is disposed in spaces between the supply openings 13 adjacent to each other in the direction along the supply opening array 19 on the substrate 6. In this embodiment, each electrode 15 is positioned at a substantially central position of the space between the adjacent supply openings 13. In this embodiment, the electrode 15 on the substrate 6 has a size of 10 μm×10 μm, but the invention is not limited to this value. The electrode 15 may be formed of the same material as the protective film 18, for example.

The electrode 15 is connected to an electrode wiring layer 22 electrically connected to an external terminal, which is not illustrated. The electrode wiring layer 22 may be formed of Ta, for example. This configuration enables power supply from an external source to the electrode 15. In other words, the electrode 15 is configured such that a voltage is applied between the electrode 15 and the protective film 18. After the liquid chamber 21 is filled with the liquid, a voltage is applied such that the protective film 18 becomes a positive side and the electrode 15 becomes a negative side. This causes an electrochemical reaction, which causes the surface of the protective film 18 in contact with the liquid to be eluted. As a result, the kogation deposited on the protective film 18 is eliminated. The liquid may be any liquid that includes an electrolyte. The liquid may be ink for printing, for example.

Figure 4A:
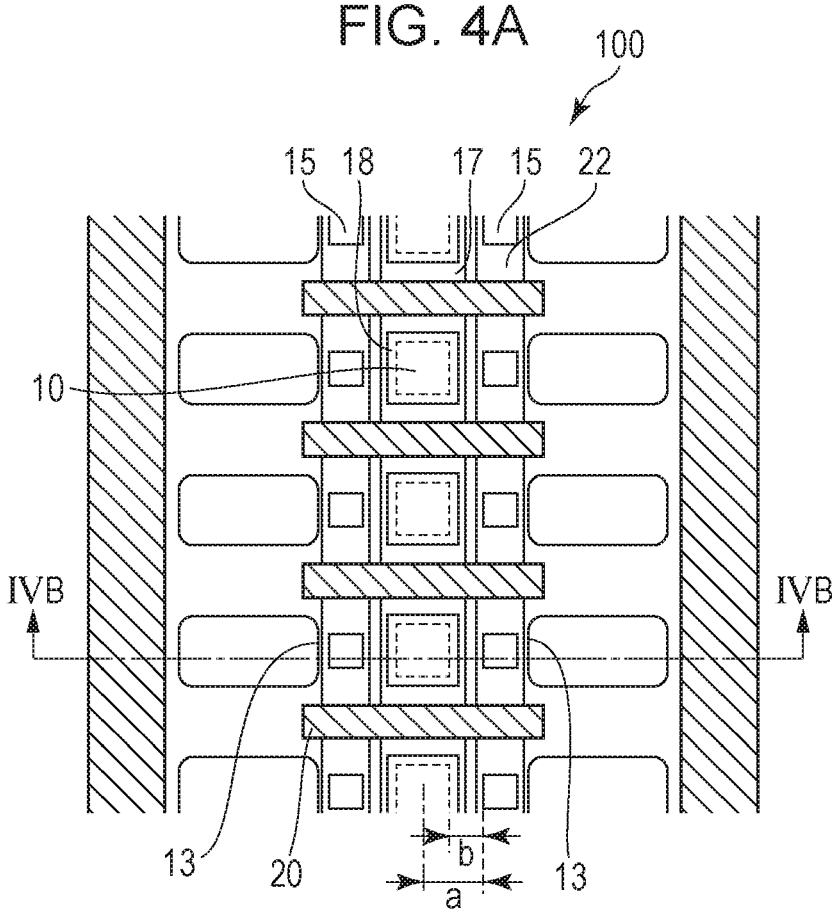
FIGS. 4A and 4B are views of a liquid ejection head of a comparative example each illustrating a portion including a heating resistor.
Figure 4B:
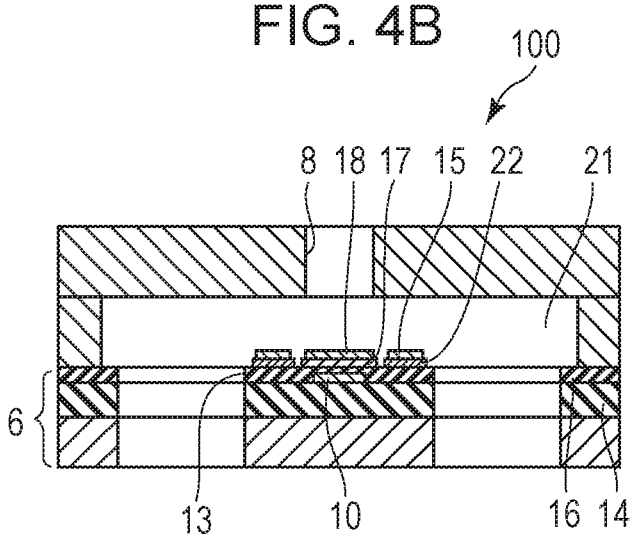
Figure 5A:
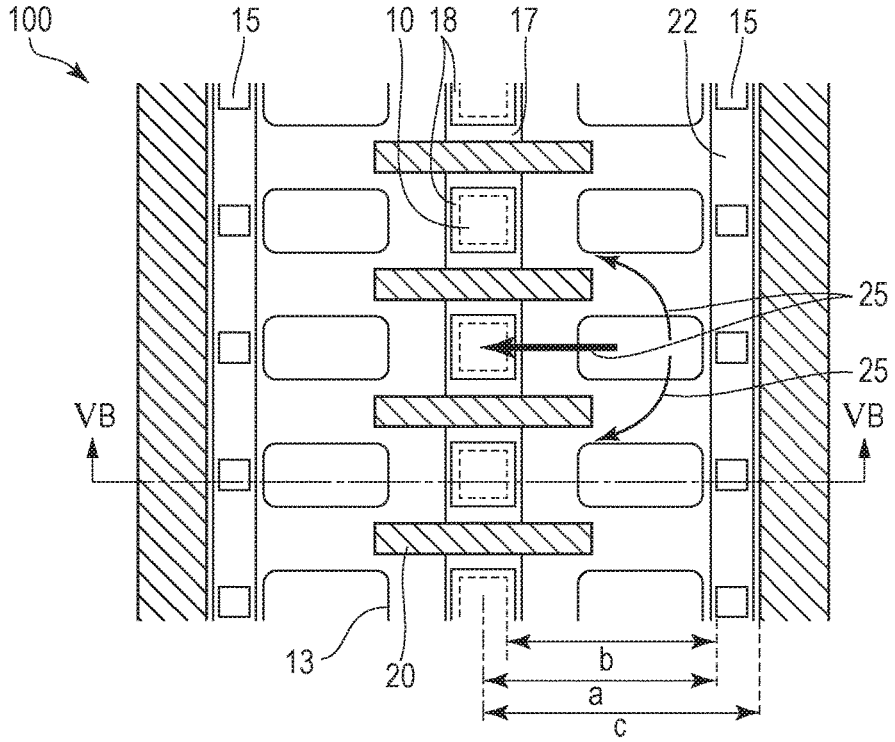
FIGS. 5A to 5C are views of a liquid ejection head of a comparative example illustrating a portion including a heating resistor.
Figure 5B:
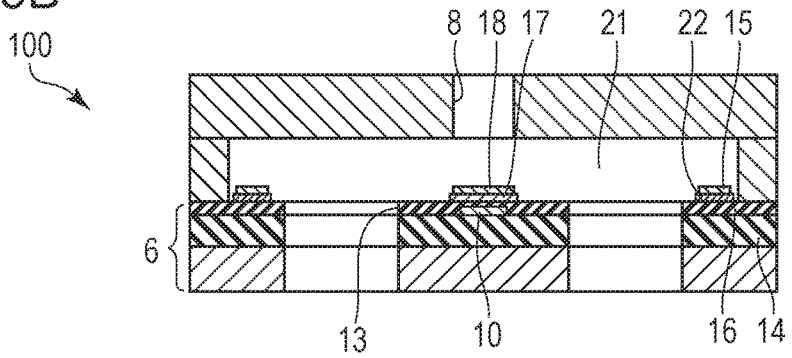
Figure 5C:
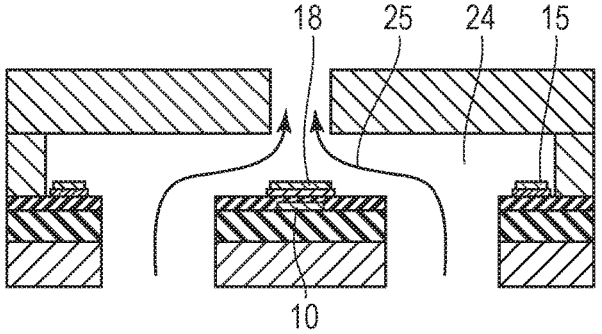

Advantages of this embodiment are described with reference to FIG. 3A to FIG. 5C. FIGS. 4A and 4B and FIGS. 5A to 5C are views of comparative examples for explaining the advantages of the present embodiment. FIG. 4A is a partial plan view illustrating a section of a liquid ejection head 100 of a comparative example 1. FIG. 4B is a cross-sectional view taken along line IVB-IVB in FIG. 4A. FIG. 5A is a partial plan view illustrating a section of a liquid ejection head 100 of a comparative example 2. FIG. 5B is a cross-sectional view taken along line VB-VB in FIG. 5A. FIG. 5C illustrates a flow of the liquid during suction recovery.

In FIGS. 4A and 4B, the electrode 15, which has the size of 10 μm×10 μm, is disposed between the supply opening 13 and the protective film 18. The maximum distance a (FIG. 4A) between the electrode 15 and the protective film 18 is 15 μm, and the minimum distance b (FIG. 4A) between the electrode 15 and the protective film is 5 μm. Thus, electric resistance between the electrode 15 and a portion of the protective film 18 farthest from the electrode 15 is about three times as large as the electric resistance between the electrode 15 and a portion of the protective film 18 closest to the electrode 15.

Herein, the distance between the protective film and the electrode 15 is a distance between a certain position in a portion of the protective film 18 overlapping the heating resistor 10 and a portion closest to the protective film 18 of one of the electrodes 15 positioned closest to the protective film 18. The distance a is measured from a position in the protective film 18 that results in the longest distance, and the distance b is measured from a position in the protective film 18 that results in the shortest distance. The same is applicable to the following description. In the comparative example 1 illustrated in FIG. 4A, since the electrode 15 is disposed on each side of an array of the heating resistors 10, the maximum distance a is a distance between the center of gravity of the protective film 18 and the electrode 15.

The component of the protective film 18 is eluted in the liquid by the electrochemical reaction to eliminate the kogation on the protective film 18. The component of the protective film 18 is less eluted at the portion of the protective film 18 including the center of gravity, which is the farthest position from the electrode 15, than at the portion of the protective film 18 closest to the electrode 15. Thus, when an operation for eliminating the kogation by using the liquid ejection head is repeated for a long period of time, the thickness of the protective film 18 varies depending on the position in the protective film 18, leading to variation in heat transfer from the heating resistor 10 to the liquid. This may cause unstable liquid ejection.

In FIGS. 5A to 5C, the electrode 15, which has the size of 10 μm×10 μm, is disposed on the substrate 6 at an opposite side of an array of the supply openings 13 from an array of the heating resistors 10. The maximum distance a (FIG. 5A) between the electrode 15 and the protective film 18 is 75 μm, and the minimum distance b between the electrode 15 and the protective film 18 (FIG. 5A) is 65 μm. Thus, the ratio of electric resistance between the electrode 15 and a portion of the protective film 18 farthest from the electrode 15 is about 1.15 times as large as the electric resistance between the electrode 15 and the portion of the protective film 18 closest to the electrode 15. The ratio of electric resistance is smaller, and the elution amount varies less depending on the position in the protective film 18. Thus, unstable liquid ejection is unlikely to occur.

However, the electrode 15 positioned as illustrated in FIGS. 5A to 5C increases the length of the surface of the substrate 6 in the direction perpendicular to the array of the ejection openings 9. In particular, if the number of the ejection opening arrays 9 is large, this configuration leads to a large increase in the size and cost of the substrate 6. As indicated in FIG. 5A, the distance c between the center of gravity of the heating resistor 10 and a wall defining the liquid chamber 21 is 90 μm, which is longer than the distance c indicated in FIG. 3A by 15 μm.

Refilling of the liquid ejection head 100 with the liquid or repeated printing may cause a bubble 24 to move to or remain in the liquid chamber 21. In such a case, the bubble 24 may enter the area where the electrode 15 is disposed. As illustrated in FIG. 5A, the flow 25 of the liquid from the supply opening 13 is unlikely to pass over the electrode 15, which is disposed at the position illustrated in FIGS. 5A to 5C, even when the liquid is sucked through the ejection openings 8 during the suction recovery, for example. As illustrated in FIG. 5C, the liquid does not flow to the surface of the electrode 15, and thus the bubbles 24 may be accumulated. The bubble may prevent the electrode 15 from being in contact with the liquid. In such a case, the voltage is not appropriately applied between the electrode 15 and the protective film 18, leading to insufficient elimination of the kogation.

Accordingly, the above-described embodiment includes the electrode 15 on the substrate 6 in the space between the supply openings 13 adjacent to each other in the direction along the supply opening array 19. The maximum distance a (FIG. 3A) between the electrode 15 and the protective film 18 is 43 μm, for example, and the minimum distance b (FIG. 3A) between the electrode 15 and the protective film 18 is 36 μm, but the invention is not limited to these values. The ratio of electric resistance between the distances a and b is about 1.19, which is as small as the ratio in the configuration illustrated in FIGS. 5A to 5C. Thus, the elution amount varies less depending on the position in the protective film 18. In addition, the substrate 6 does not increase in length in the direction perpendicular to the ejection opening array 9 on the substrate 6 unlike in the comparative example 2 illustrated in FIGS. 5A to 5C. In addition, as illustrated in FIG. 3D, the flow of the liquid passes over the electrode 15 during suction recovery. Thus, the generated bubble is unlikely to be left on the electrode 15, leading to a reduction in insufficient elimination of the kogation possibly due to the accumulated bubbles.

As described above, in this embodiment, the supply opening 13 and the pressure chamber 11 are positioned close to each other to accelerate the refilling of the pressure chamber 11 with the liquid for high-speed printing, and the protective film 18 and the electrode 15 are positioned sufficiently away from each other to reduce the variation in the elution amount of the protective film 18. Thus, the stable ejection is maintained. In addition, this configuration reduces an increase in size of the liquid ejection head substrate 6. Furthermore, this configuration reduces the possibility that the accumulated bubbles may prevent the elimination of the kogation.

The electrode 15 may be positioned such that the distance between the electrode 15 and the protective film satisfies a relationship $1<a/b\leq 2$, in which a represents the maximum distance and b represents the minimum distance. This makes the effect due to the variations in the elution amount depending on the position in the protective film 18 negligible even when the operation for eliminating the kogation is repeated for a long period of time by using the liquid ejection head 100.

The heating resistor 10 may be disposed in a through hole (not illustrated) in the insulating layer 14, and may be connected to an electrode wiring layer in the insulating layer 14. The electrode wiring layer may be formed of a metal material such as Al, Al—Si, and Al—Cu. In this configuration, wiring connected to the heating resistor 10 is not disposed in the space between the supply openings 13 on the substrate 6, and as a result, the space for the electrode 15 is readily left between the supply openings 13.

To reduce the size of the substrate 6 in the direction intersecting the array of the heat resistors 10, the electrode 15 may be disposed at a position closer than a portion of the supply opening 13 farthest from the array of the heating resistors 10 to the array of the heating resistors 10 as illustrated in FIG. 3A. In other words, the electrode 15 may be disposed so as to be within the space between the adjacent supply openings 13 in a direction away from the heating resistor array 26.

Figure 6A:
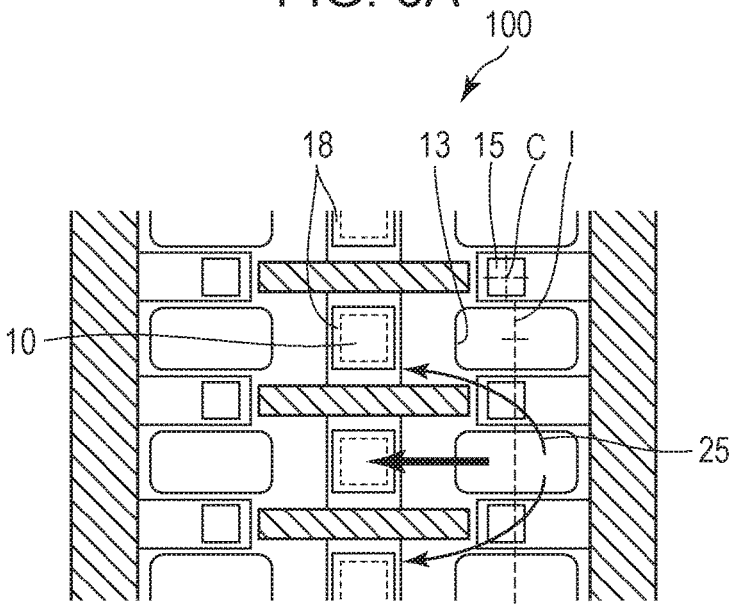
FIGS. 6A and 6B are views of a liquid ejection head according to a modification of the first embodiment each illustrating a portion including a heating resistor.

As illustrated in FIG. 6A, the electrode 15 may be positioned such that a center of gravity C of the electrode 15 is closer than a straight line 1 to the array of the heating resistors 10. The straight line 1 connects the centers of gravity of the supply openings 13 adjacent to each other with the electrode 15 disposed therebetween in an array direction of the supply openings in which the supply openings 13 are arranged. This configuration enables the flow 25, which flows from the supply opening 13 toward the ejection opening 8 during suction recovery or refilling of the liquid, to readily pass over the electrode 15, leading to a reduction in the accumulated bubbles.

Figure 6B:
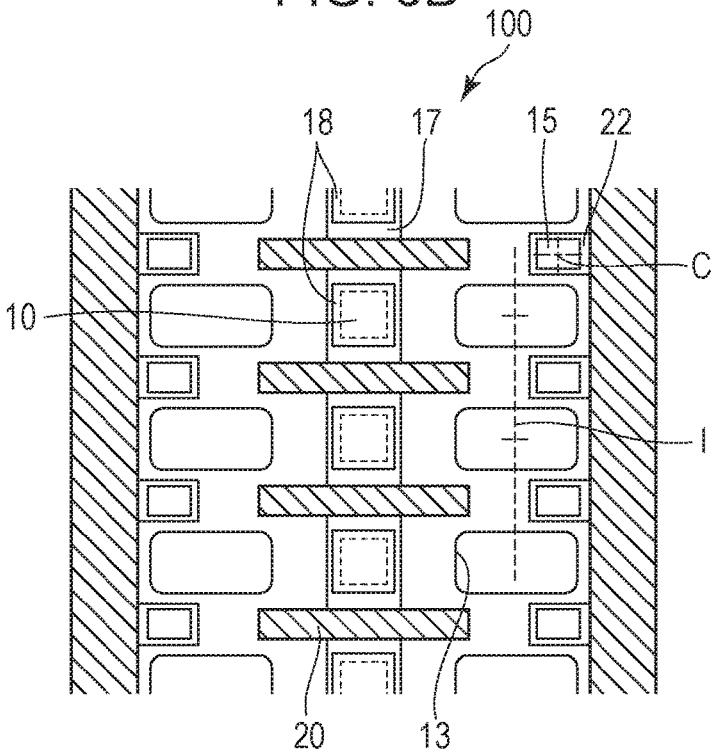

On the contrary, the electrode 15 may be positioned as illustrated in FIG. 6B so as to sufficiently separate the protective film 18 from the electrode 15. Specifically, the center of gravity C of the electrode 15 is positioned father than the straight line 1, which connects the centers of gravity of the supply openings 13 adjacent to each other with the electrode 15 disposed therebetween in the array direction, from the array of the heating resistors 10.

In some embodiments, the electrode 15 is not entirely positioned in the space between the adjacent supply openings 13. At least a portion of the electrode 15 is disposed between the supply openings 13 adjacent to each other in the array direction of the supply openings 13.

In some embodiments, the electrode 15 is disposed in each space between the supply openings 13 of the supply opening array 19. This configuration enables further uniform elimination of the kogation from the protective film 18.

Second Embodiment

Figure 7:
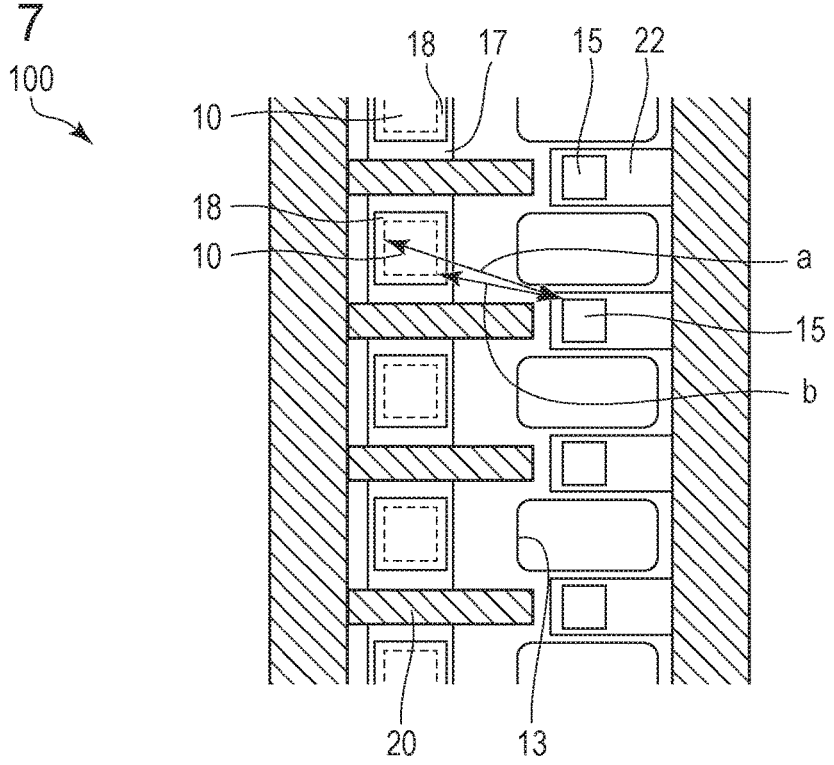
FIG. 7 is a view of a liquid ejection head according to a second embodiment illustrating a portion including a heating resistor.

A second embodiment is described with reference to FIG. 7. Components of the second embodiment identical to those of the above-described embodiment are assigned the same reference numerals as those of the above-described embodiment and are not described. Components of the second embodiment different from those of the above-described embodiment are described.

The array of the supply openings 13 is disposed on one side of the array of the heating resistors 10 in this embodiment, while the array of the supply openings 13 is disposed on each side of one array of the heating resistors 10 in the above-described embodiments. In this embodiment, the maximum distance a and the minimum distance b between the electrode 15 and the protective film 18 are as indicated in FIG. 7.

Third Embodiment

A third embodiment is described with reference to FIG. 8. Components of the third embodiment identical to those of the above-described embodiments are assigned the same reference numerals as those of the above-described embodiments and are not described. Components of the third embodiment different from those of the above-described embodiments are described.

In this embodiment, the number of the supply openings 13 included in the supply opening array 19 is smaller than that in the above-described embodiments. Specifically, each of the supply openings 13 is adjacent to at least two of the heating resistors 10 in this embodiment, while each of the supply openings 13 is adjacent to a corresponding one of the heating resistors 10 in the above-described embodiments. More specifically, in this embodiment, each of the supply openings 13 is connected to two channels 12 such that the liquid is supplied from one supply opening 13 to at least two pressure chambers 11. The pressure chamber 11 is desired to be refilled rapidly with the liquid after the liquid is ejected through the ejection opening 8 to achieve high-speed printing. Accordingly, the pressure chamber 11 and the supply opening 13 are desired to be positioned close to each other, and the pressure loss of the supply opening 13 is desired to be small.

The pressure loss of a passage having a substantially rectangular shape is smaller as the aspect ratio thereof is smaller. In this embodiment, the supply opening 13, which is connected to two channels 12, has a length j of 40 μm and a width i of 30 μm (FIG. 8), for example. In the above-described embodiments, the supply opening 13, which is connected to one channel 12, has the width g of 20 μm and the length h of 40 μm (FIG. 3A). The pressure loss of the supply opening 13 in the third embodiment and that of the supply opening 13 in the above-described embodiments are substantially the same.

In this embodiment, one supply opening 13 is connected to the plurality of channels 12 as described above. This configuration reduces an increase in the pressure loss of the supply opening 13 and reduces the size of the supply opening 13 in the direction intersecting the array direction of the supply openings 13 (direction perpendicular to the array direction in this embodiment).

Figure 8:
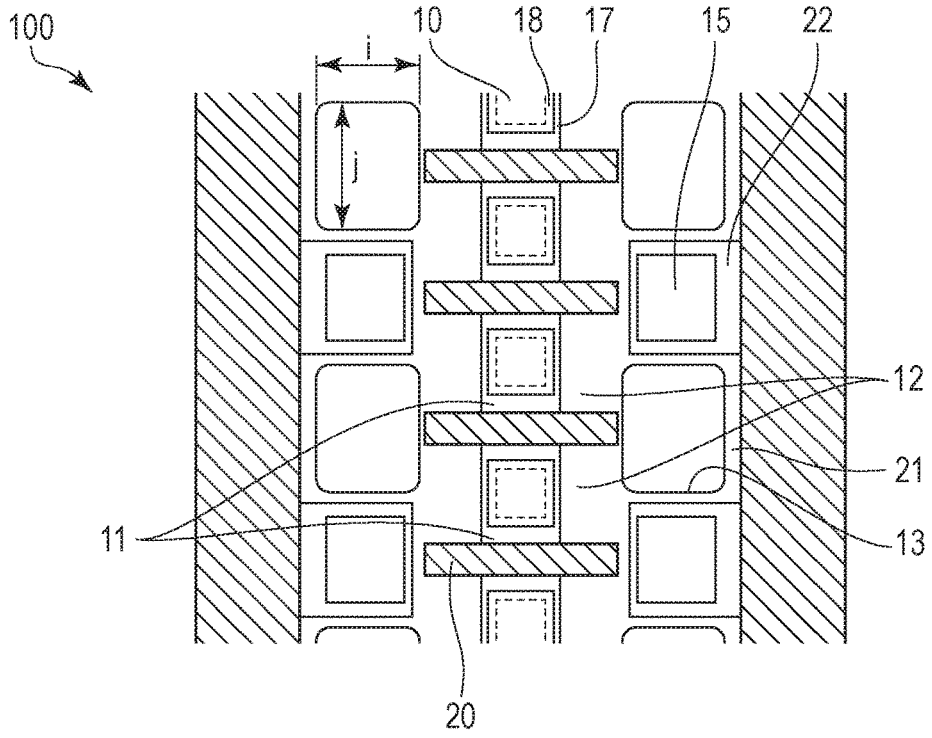
FIG. 8 is a view of a liquid ejection head according to a third embodiment illustrating a portion including a heating resistor.

In FIG. 8, one supply opening 13 is connected to the two channels 12 through the liquid chamber 21. However, in some embodiments, the number of the channels connected to one supply opening 13 is three or more.

Fourth Embodiment

Figure 9:
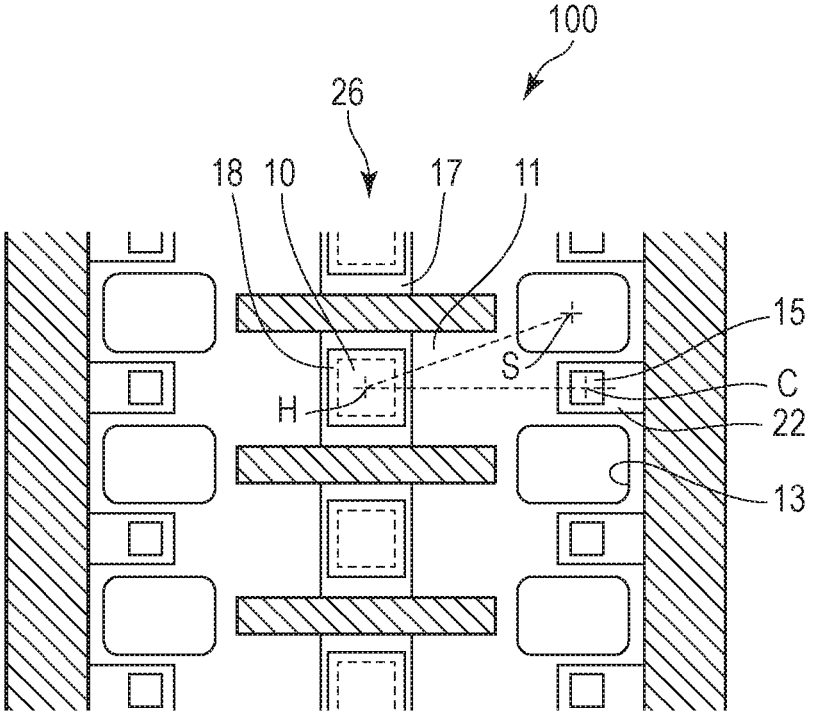
FIG. 9 is a view of a liquid ejection head according to a fourth embodiment illustrating a portion including a heating resistor.

A fourth embodiment is described with reference to FIG. 9. Components of the fourth embodiment identical to those of the above-described embodiments are assigned the same reference numerals as those of the above-described embodiments and are not described. Components of the fourth embodiment different from those of the above-described embodiments are described.

In this embodiment, a center of gravity H of the heating resistor 10 and the center of gravity C of one of the electrodes 15 positioned closest to the heating resistor 10 are positioned side by side in the direction perpendicular to the heating resistor array 26. In other words, the electrode 15 is positioned such that a line connecting the center of gravity H of the heating resistor 10 and the center of gravity C of the electrode 15 on the substrate 6 extends in the direction perpendicular to the heating resistor array 26. Furthermore, a straight line connecting the center of gravity H of the heating resistor 10 and the center of gravity S of the supply opening 13 extends in a direction intersecting the direction perpendicular to the heating resistor array 26.

In this embodiment, the electrode 15 is positioned between the supply openings 13 adjacent to each other in the array direction of the supply openings 13, and the protective film 18 and the electrode 15 are sufficiently separated from each other such that the variation in the elution amount of the protective film 18 is reduced as the above-described embodiments. Thus, the stable ejection is maintained. In addition, this configuration reduces an increase in the size of the liquid ejection head substrate 6 in the direction intersecting the array direction of the supply openings 13.

The electrode 15 may be positioned as in the above-described embodiments, not as in this embodiment, so as to have a larger distance between the protective film 18 and the electrode 15. Specifically, as in the above-described embodiments, the center of gravity of the heating resistor 10 and the center of gravity of one of the electrodes 15 positioned closest to the heating resistor 10 may not be aligned in the direction perpendicular to the heating resistor array 26.

Other Embodiments

Other embodiments are described with reference to FIGS. 10A to 10C. Components of the other embodiments identical to those of the above-described embodiments are assigned the same reference numerals as those of the above-described embodiments and are not described. Components of the other embodiments different from those of the above-described embodiments are described.

Figure 10A:
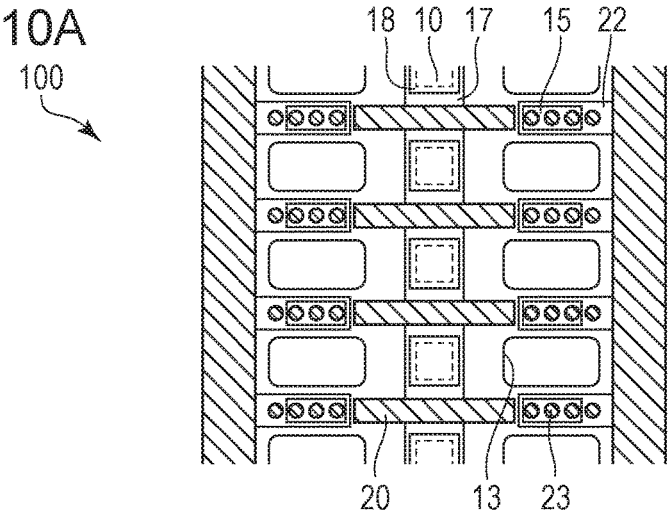
FIGS. 10A to 10C are views of a liquid ejection head according to other embodiments each illustrating a portion including a heating resistor.
Figure 10B:
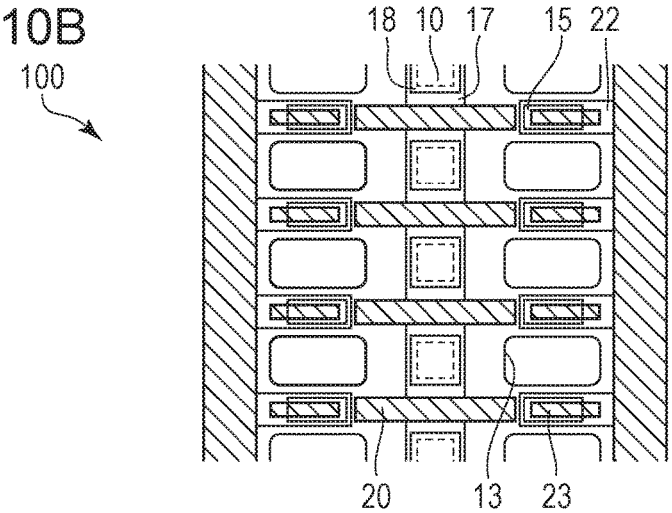
Figure 10C:
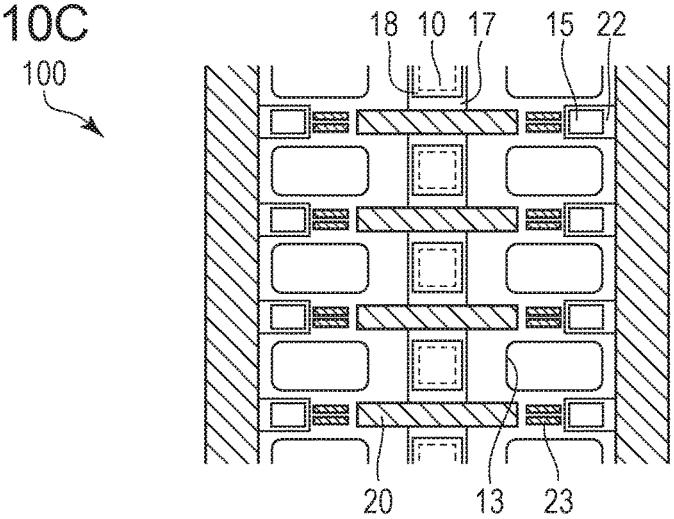

In the embodiments illustrated in FIGS. 10A to 10C, a pillar 23 is disposed in the space between the supply openings 13 where the electrode 15 is disposed. The pillar 23 is a connecting portion connecting the ejection opening defining member 7 and the substrate 6 to each other. In the above-described embodiments, a portion of the surface of the substrate 6 positioned between the supply openings 13 is not in contact with the ejection opening defining member 7. If a space between the ejection opening defining member 7 and the substrate 6 is large, the liquid ejection head 100 may be broken or deformed.

In this embodiment, the pillar 23 disposed between the supply openings 13 enables the liquid to flow from the supply opening 13 to the ejection opening 8 over the electrode 15 and improves reliability of the liquid ejection head 100. In some embodiments, the pillar 23 is composed of a plurality of separate pillars as illustrated in FIG. 10A or is composed of a wall as illustrated in FIG. 10B.

The configurations illustrated in FIG. 10A and FIG. 10B include the pillar 23 on the electrode 15. However, in some embodiments, the pillar 23 is disposed in the space between the supply openings 13 where the electrode 15 is not disposed as illustrated in FIG. 10C. This configuration enables a sufficient area of the electrode 15 to be left for the operation for eliminating the kogation. In some embodiments, a plurality of pillars are arranged in the array direction of the supply openings 13 in the space between the supply openings 13.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-128154, filed Jun. 25, 2015, which is hereby incorporated by reference herein in its entirety.

What is claimed is:

1. A liquid ejection head substrate comprising:

a heating resistor array including a plurality of heating resistors;

a protective film covering at least one of the heating resistors;

a supply opening array on a side of a surface of the liquid ejection head substrate on which the protective film is provided, the supply opening array including a plurality of supply openings through which a liquid is supplied arranged in a direction along the heating resistor array; and an electrode disposed on the side of the surface in a space between the supply openings adjacent to each other in a direction along the supply opening array, the electrode being configured such that a voltage is applied between the electrode and the protective film, wherein the protective film and the electrode are each disposed at a position at which the protective film and the electrode are touchable with a liquid.

2. The liquid ejection head substrate according to claim 1, wherein a center of gravity of the heating resistor and a center of gravity of the electrode adjacent to the heating resistor are not aligned in a direction perpendicular to the heating resistor array on the side of the surface.

3. The liquid ejection head substrate according to claim 1, wherein the electrode is disposed closer than portions of the supply openings farthest from the heating resistor array to the heating resistor array, the supply openings being adjacent to each other with the electrode disposed therebetween.

4. The liquid ejection head substrate according to claim 1, wherein a center of gravity of the electrode is positioned closer than a line connecting centers of gravity of the supply openings to the heating resistor array, the supply openings being adjacent to each other with the electrode disposed therebetween.

5. The liquid ejection head substrate according to claim 1, wherein a center of gravity of the electrode is positioned farther than a line connecting centers of gravity of the supply openings from the heating resistor array, the supply openings being adjacent to each other with the electrode disposed therebetween.

6. The liquid ejection head substrate according to claim 1, wherein the protective film and the electrode are each formed of iridium (Ir) or ruthenium (Ru).

7. The liquid ejection head substrate according to claim 1, wherein the protective film and the electrode are adjacent to a channel through which a liquid flows.

8. The liquid ejection head substrate according to claim 1, wherein the electrode is disposed in each space between the supply openings of the supply opening array.

9. The liquid ejection head substrate according to claim 1, wherein the supply openings of the supply opening array are each adjacent to a corresponding one of the plurality of heating resistors of the heating resistor array.

10. The liquid ejection head substrate according to claim 1, wherein the supply openings of the supply opening array are each adjacent to at least two corresponding heating resistors of the plurality of heating resistors of the heating resistor array.

11. The liquid ejection head substrate according to claim 1, wherein, with a voltage between the electrode and the protective film being applied, electrochemical reaction is generated, and the protective film is eluted into a liquid.

12. The liquid ejection head substrate according to claim 1, further comprising an insulating layer positioned between the heating resistor and the protective film, wherein the electrode is disposed on a side, of the insulating layer, on which the protective film is provided.

13. The liquid ejection head substrate according to claim 1, further comprising an electrode wiring layer connected to the heating resistor.

14. A liquid ejection head comprising:

a liquid ejection head substrate including a heating resistor array including a plurality of heating resistors, a protective film covering at least one of the heating resistors, a supply opening array on a side of a surface of the liquid ejection head substrate on which the protective film is provided, the supply opening array including a plurality of supply openings through which a liquid is supplied arranged in a direction along the heating resistor array, and an electrode disposed on the side of the surface in a space between the supply openings adjacent to each other in a direction along the supply opening array, the electrode being configured such that a voltage is applied between the electrode and the protective film and an ejection opening defining member having an ejection opening through which a liquid is ejected; and a channel through which a liquid supplied from each of the plurality of supply openings flows, wherein the protective film and the electrode are each disposed at a position at which the protective film and the electrode are touchable with a liquid in the channel.

15. The liquid ejection head according to claim 14, wherein a center of the heating resistor and a center of the electrode adjacent to the heating resistor are not aligned in a direction perpendicular to the heating resistor array on the side of the surface.

16. The liquid ejection head according to claim 14, further comprising a connecting portion in a space between the supply openings adjacent to each other, the connecting portion connecting the liquid ejection head substrate and the ejection opening defining member to each other.

17. The liquid ejection head according to claim 16, wherein the connecting portion is disposed at a position away from the electrode.

18. The liquid ejection head according to claim 14 wherein, with a voltage between the electrode and the protective film being applied, electrochemical reaction is generated, and the protective film is eluted into a liquid.

* * * * *